United States Patent [19]

Crutcher

[11] Patent Number: 4,519,535

[45] Date of Patent: May 28, 1985

[54] FLYWHEEL FOR AN ELECTRO-MECHANICAL FASTENER DRIVING TOOL

[75] Inventor: John P. Crutcher, Cincinnati, Ohio

[73] Assignee: Sencorp, Cincinnati, Ohio

[21] Appl. No.: 479,964

[22] Filed: Mar. 29, 1983

[51] Int. Cl.[3] ..... B25C 1/06

[52] U.S. Cl. ..... 227/131; 227/120; 227/156

[58] Field of Search ..... 227/8, 120, 130, 131, 227/156

[56] References Cited

U.S. PATENT DOCUMENTS

| | | | |
|---|---|---|---|
| 3,946,436 | 3/1976 | Takashino et al. | 242/191 |
| 4,121,745 | 10/1978 | Smith et al. | 227/131 X |
| 4,129,240 | 12/1978 | Geist | 227/131 X |
| 4,189,080 | 2/1980 | Smith et al. | 227/131 X |
| 4,204,622 | 5/1980 | Smith et al. | 227/131 X |
| 4,298,072 | 11/1981 | Baker et al. | 227/131 X |
| 4,323,127 | 4/1982 | Cunningham | 227/131 X |

*Primary Examiner*—Paul A. Bell

*Attorney, Agent, or Firm*—Frost & Jacobs

[57] ABSTRACT

An improved flywheel for an electro-mechanical tool, such as a nailer or stapler. The tool is of the type provided with a driver which is frictionally moved through a working stroke by means of an electrically driven flywheel which presses the driver against a support element, such as a counterrotating flywheel, a low inertia roller, or the like. The flywheel is provided with circumferential grooves while maintaining the optimum contact area between the flywheel and the driver. The grooves provide voids along the travelling driver-flywheel contact line into which foreign material on the driver and flywheel flows to prevent build-up of such foreign material at the driver-flywheel contact area sufficient to result in loss of friction therebetween.

19 Claims, 5 Drawing Figures

FLYWHEEL FOR AN ELECTRO-MECHANICAL FASTENER DRIVING TOOL

TECHNICAL FIELD

The invention relates to an improved flywheel for an electro-mechanical fastener driving tool, and more particularly to such a flywheel provided with circumferential grooves to prevent the build-up of foreign material on the driver-flywheel contact area sufficient to cause loss of friction therebetween.

BACKGROUND ART

Powered nailers and staplers are well known and have come into wide-spread use. This is true because they can drive fasteners more rapidly and more precisely than can be accomplished manually. In their most common form, such powered nailers and staplers are actuated by compressed air, necessitating the presence of an air compressor and long lengths of hose.

Recently, there has been much interest in electrically powered nailers and staplers, requiring only a source of electrical energy. Electrical energy is always present at a construction site. Such tools are also appropriate for the home market where electrical energy is readily available.

Prior art workers have devised many types of electro-mechanical fastener driving tools. For example, U.S. Pat. Nos. 4,042,036; 4,204,622; and 4,323,127 each teach an electric impact tool wherein the driver is frictionally moved through a working stroke by means of two counterrotating flywheels, each flywheel being provided with its own electric motor. U.S. Pat. No. 4,121,745 also teaches an electric impact tool utilizing counterrotating flywheels to frictionally move the driver through its working stroke. In this instance, however, one flywheel is directly driven by an electric motor, while the other flywheel is driven by the same electric motor through the agency of pulleys and an elastomeric belt or gear means.

U.S. Pat. Nos. 4,189,080 and 4,298,072 teach electro-mechanical fastener driving tools wherein the driver is moved through a working stroke by means of a single rotating, high-speed flywheel. The driver is engaged between the single flywheel and a support element. The preferred form of support element comprises a low inertia roller. Both patents teach, however, that other support means, such as a linear bearing or a Teflon block, could be used to accomplish the same purpose.

Electro-mechanical tools of the general class described above can be used to drive nails, staples or the like. For purposes of an exemplary showing, the present invention will be described in terms of its application to an electro-mechanical nailer. It will be understood by one skilled in the art, however, that the teachings of the present invention are equally applicable to electromechanical staple driving tools.

All such electro-mechanical fastener driving tools share a common problem. This problem is one of build-up of foreign material on the driver and transfer of the foreign material from the driver to the flywheel. Ultimately, a good drive is no longer possible because friction between the driver and the flywheel is lost.

For example, it is common practice to arrange the nails in the tool magazine in parallel-spaced relationship and to maintain them in this relationship through the use of strips of tape coated with a thermoplastic hot melt glue. It is also common practice to coat at least the initial driven portion of each nail shank with a resin based coating, or the like, to assist the nail's penetration of the workpiece and to increase the nail's holding power, once driven.

Since the driver is moved through its working stroke by means of frictional engagement with at least one flywheel, the driver will tend to get hot during use of the tool. In fact, the driver gets hot enough to melt the hot melt glue or the coating on the nail, or both. As the driver moves between the flywheels (or the flywheel and a back-up means) under a squeeze force, the melted material builds up in front of the driver-flywheel contact area until a planing or floating action occurs, and the driver-flywheel contact is actually reduced enough to lose friction and thus the driving force. Under these circumstances, driver power can only be restored by disassembling the tool and cleaning the driver and the one or more flywheels.

The present invention is based upon the discovery that if the flywheel is provided with circumferential grooves (or both flywheels are provided with circumferential grooves, where two flywheels are used), a build-up of foreign material resulting in a loss of friction between the one or more flywheels and the driver will not occur. The grooves are provided while maintaining the optimum total contact area between the one or more flywheels and the driver. The grooves provide voids along the driver-flywheel contact line into which the foreign material tends to flow. As a result, a positive frictional engagement of the driver by the one or more flywheels is achieved cycle-after-cycle. The working life of the one or more flywheels, and particularly the working life of the driver, are greatly increased. This is true because wear of the flywheels, and particularly the driver, is minimized.

DISCLOSURE OF THE INVENTION

According to the invention, there is provided an improved flywheel for an electro-mechanical tool, such as a nailer or stapler. The tool is of the type having a driver which is frictionally moved through a working stroke by means of an electrically driven flywheel. The flywheel presses the driver against a support element. The support element may take the form of a second counterrotating, driven flywheel, a low inertia roller, a linear bearing, or a Teflon block.

In accordance with the invention, the flywheel is provided with circumferential grooves while maintaining the optimum contact area between the flywheel and the driver. When two driven flywheels are present in the tool, both will be provided with circumferential grooves.

The grooves provide voids along the travelling driver-flywheel contact line into which the hot melt glue, the nail coating, or other foreign material on the driver and flywheel flows. This prevents a build-up of such material at the driver-flywheel contact area which might otherwise be sufficient to result in loss of friction between the driver and the flywheel and the consequent impairment of the working stroke.

BRIEF DESCRIPTION OF THE DRAWINGS

FIG. 3 is a fragmentary, semi-diagrammatic view illustrating the driver, the flywheel and the low inertia back-up roller of a conventional electro-mechanical fastener driving tool, showing the problem of build-up of foreign material between the driver and the flywheel.

DETAILED DESCRIPTION OF THE INVENTION

Figure 2D:
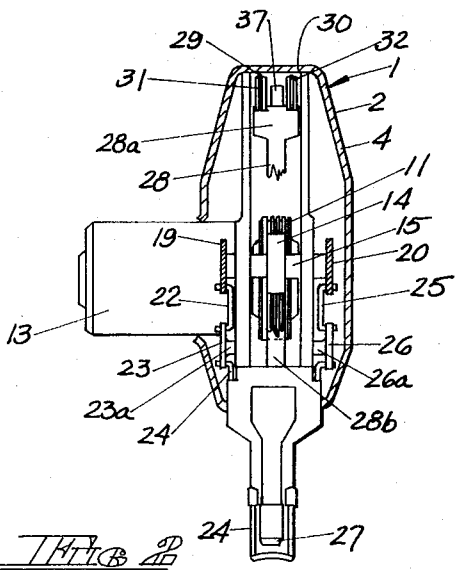
FIG. 2 is a cross-sectional view taken along section line 2—2 of FIG. 1.
Figure 1:
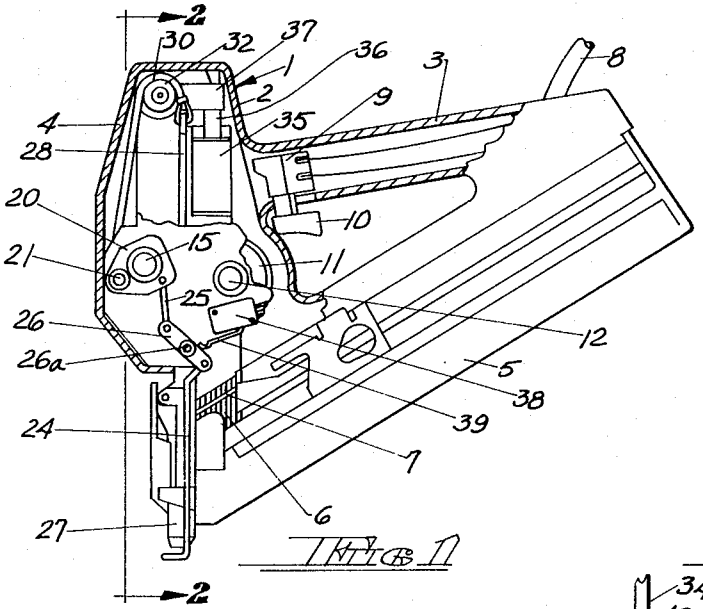
FIG. 1 is an elevational view, partly in cross-section, illustrating an electro-mechanical fastener driving tool provided with the improved flywheel of the present invention.

The teachings of the present invention are applicable to any electro-mechanical fastener driving tool of the type wherein the tool driver is moved through a working stroke by frictional engagement thereof with at least one rotating high speed flywheel. For purposes of a nonlimiting, exemplary showing, the present invention will be described in terms of its application to an electro-mechanical nailer of the type set forth in the above noted U.S. Pat. No. 4,298,072. Reference is first made to FIGS. 1 and 2, wherein like parts have been given like index numerals.

The tool is generally indicated at 1 and comprises a housing 2 having a handle portion 3, a main body portion 4 and a magazine portion 5. The magazine 5 contains a plurality of nails, some of which are shown at 6. The nails are maintained in parallel-spaced relationship by strips of paper tape or the like, coated with hot melt glue. One such tape strip is shown at 7.

The tool 1 is connected to a source of electrical current by an appropriate conductor 8. The handle portion 3 contains a switch 9 operated by a manual trigger 10.

The main body portion 4 contains the flywheel 11 of the present invention. The flywheel 11 is mounted on the shaft 12 of an electric motor 13.

A back-up means, in the form of a low inertia roller 14, is mounted on a shaft 15 supported between a pair of plates 19 and 20. The plates 19 and 20 are themselves pivotally affixed to an appropriately supported shaft 21 (see FIG. 1). By virtue of the pivotal mounting of plates 19 and 20, the back-up roller 11 is swingable toward and away from flywheel 11.

The plate 19 is connected by link 22 to the forward end of a bell crank 23. The bell crank 23 is pivoted as at 23*a*. The rearward end of the bell crank 23 is pivotally connected to the upper end of a workpiece responsive trip 24. In similar fashion, the plate 20 is pivotally connected by a link 25 to the forward end of a bell crank 26. The bell crank 26 is pivotally mounted at 26*a*. The rearward end of bell crank 26 is also pivotally mounted to the upper end of workpiece responsive trip 24.

It will be noted from FIGS. 1 and 2 that the workpiece responsive trip 24 normally extends below the nose portion 27 of tool 1. In fact, means (not shown) are provided to bias the workpiece responsive trip 24 to its normal or lower position. When the tool 1 is brought to bear against a workpiece, with its nose portion 27 on the workpiece to be nailed, the workpiece responsive trip 24 will be shifted upwardly. This will cause bell cranks 23 and 26 to rotate (bell crank 26 rotating in a counterclockwise direction as viewed in FIG. 1). As a result of this rotation of the bell cranks, the links 22 and 25 will pull downwardly upon plates 19 and 20, causing them to rotate about their pivotal mounting 21. Thus, plate 20 will rotate in a clockwise direction about its pivotal mounting 21, as viewed in FIG. 1. When the plates 19 and 20 are in their normal positions shown in FIGS. 1 and 2, the low inertia back-up roller 14 will be in its normal position remote from flywheel 11. When the workpiece responsive trip 24 is depressed, rotation of plates 19 and 20 about their pivotal mounting 21 will cause the low inertia back-up roller 14 to swing toward flywheel 11, to a position wherein the distance between the low inertia roller 14 and the flywheel is less than the thickness of the instrument driver.

The instrument driver is illustrated in FIGS. 1 and 2 at 28. The driver comprises an elongated planar member of uniform width, except at its upper end 28*a* which may be enlarged as shown in FIG. 2, to give the driver a T-shaped configuration. The lower end 28*b* of the driver 28 is located in a channel or driver track in the nose portion 27 of nailer 1.

To maintain the driver 28 in its upper or normal position when not being driven, a return mechanism is provided. This return mechanism may take any appropriate form. For purposes of an exemplary showing, the return mechanism is illustrated as comprising a pair of elastic cords 29 and 30. The cords 29 and 30 are tied, or otherwise fastened to the enlarged upper end 28*a* of driver 28. The elastic cords 29 and 30 pass over pulleys 31 and 32, respectively. The other ends of elastic cords 29 and 30 are appropriately anchored by conventional means (not shown). In this way, the elastic means will enable the driver to be driven downwardly (as viewed in FIGS. 1 and 2) to drive a nail into a workpiece, but will, upon release of the driver by the flywheel 11 and low inertia roller 14, return the driver to its normal position illustrated in FIGS. 1 and 2.

The driver 28 is of uniform thickness throughout its length, with the exception that it is provided with a transverse notch (not shown) similar to the transverse notch 33 of driver 34 in FIG. 3. It will be remembered that when the low inertia roller 14 is shifted toward flywheel 11 by the workpiece responsive trip 24, it will be spaced from the flywheel by a distance less than the thickness of the driver. The notch in driver 28 is so positioned on the driver as to lie opposite flywheel 11 when the driver is in its normal position illustrated in FIGS. 1 and 2. As a consequence, the low inertia roller 14 can be shifted to its active position adjacent flywheel 11 without causing the driver 28 to be advanced through its working stroke by the flywheel.

In order for the driver 28 to be driven by flywheel 11, it is necessary to shove the driver 28 downwardly (as viewed in FIGS. 1 and 2) until its portion of uniform thickness enters between flywheel 11 and low inertia roller 14 to be frictionally engaged thereby. Either flywheel 11 or low inertia roller 14 is so mounted as to yield slightly to accommodate the normal thickness of the driver, while maintaining a frictional engagement between the driver and the flywheel.

The downward movement of the flywheel is accomplished through the agency of a solenoid 35. The solenoid 35 has a core 36 provided with a laterally extending end piece 37 which overlies the enlarged end 28*a* of driver 28. Thus, when the solenoid 35 is energized, its core 36 and end piece 37 will move downwardly, forcing the driver 28 between flywheel 11 and low inertia roller 14, resulting in the driver being moved through its working stroke.

The solenoid 35 is actuated by manual trigger 10 and switch 9. In the same circuit, there is a safety switch 38 having a contact member 39. The circuit, including switch 9 and solenoid 35, cannot be closed by trigger 10 unless contact member 39 of safety switch 38 is in its switch-closed position. The contact member 39 of switch 38 is shifted to its closed position by the rearward end of bell crank 26 when the workpiece responsive trip 24 is depressed against a workpiece.

It will be clear from the above description that when the nose 27 of tool 1 is pressed against the workpiece, the workpiece responsive trip 24 will shift upwardly pivoting bell crank 26. This accomplishes two purposes. First of all, it causes the low inertia roller 14 to shift toward the flywheel 11 to its active position. Simultaneously, the contact member 39 of safety switch 38 is closed, enabling the circuit containing trigger actuated switch 9 and solenoid 35. When the manual trigger 10 is depressed, the solenoid 35 will be actuated, resulting in the forcing of the driver 28 between flywheel 11 and low inertia roller 14, thus causing driver 28 to be moved through its working stroke, driving a nail into the workpiece.

When the tool 1 is lifted from the workpiece, the workpiece responsive trip 24 will shift to its normal position illustrated in FIGS. 1 and 2, causing the low inertia roller to pivot to its normal or retracted position. Safety switch 38 will simultaneously be switched to its off or open position, returning the core 36 and end piece 37 of solenoid 35 to their normal position, even if the trigger 10 is held closed by the operator. The elastic cords 29 and 30 will return driver 28 to its normal position and the tool will be ready for its next cycle.

Since the driver 28 is driven by a frictional engagement with flywheel 11, it will be appreciated that the driver will get hot. In fact, the driver will get hot enough to melt the hot melt glue on the adjacent part of the tape or tapes (one of which is shown at 7) maintaining the nails 6 in proper position within magazine 5. The driver is also hot enough to melt any applied coating on the nails. These melted materials tend to stick to the driver and then transfer to the flywheel.

FIG. 3 is a semi-diagrammatic representation of a driver 34, equivalent to driver 28; a low inertia roller 40, equivalent to roller 14; and a conventional flywheel 41. As the driver 34 moves between the flywheel 41 and the back-up roller 41 under a squeeze force, the foreign material on the driver 34 and flywheel 41 tends to build up in front of the moving driver-flywheel contact line, as shown at 42. This build-up continues until a planing or floating action occurs, and the driver-flywheel contact is actually reduced enough to lose friction and thus driving force. When this happens, a good drive is no longer possible because the friction between the driver 34 and flywheel 41 has been lost. This situation can occur after a relatively small number of cycles. Driver power can only be restored by disassembling the tool and cleaning the flywheel 41 and driver 34. Furthermore, this contamination can also accelerate wear of the driver, markedly reducing its working life.

Figure 5:
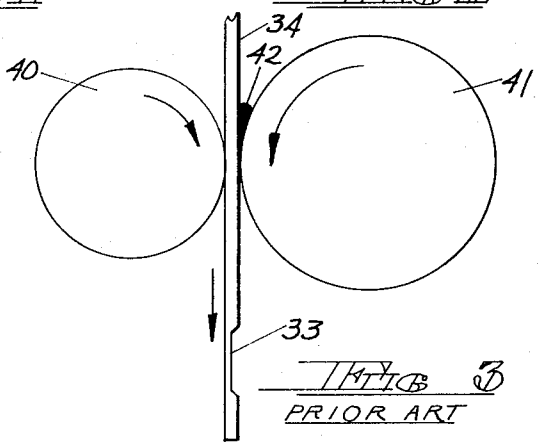
FIG. 5 PRIOR ART
FIG. 5 is a cross-sectional view taken along section line 5—5 of FIG. 4.
Figure 5:
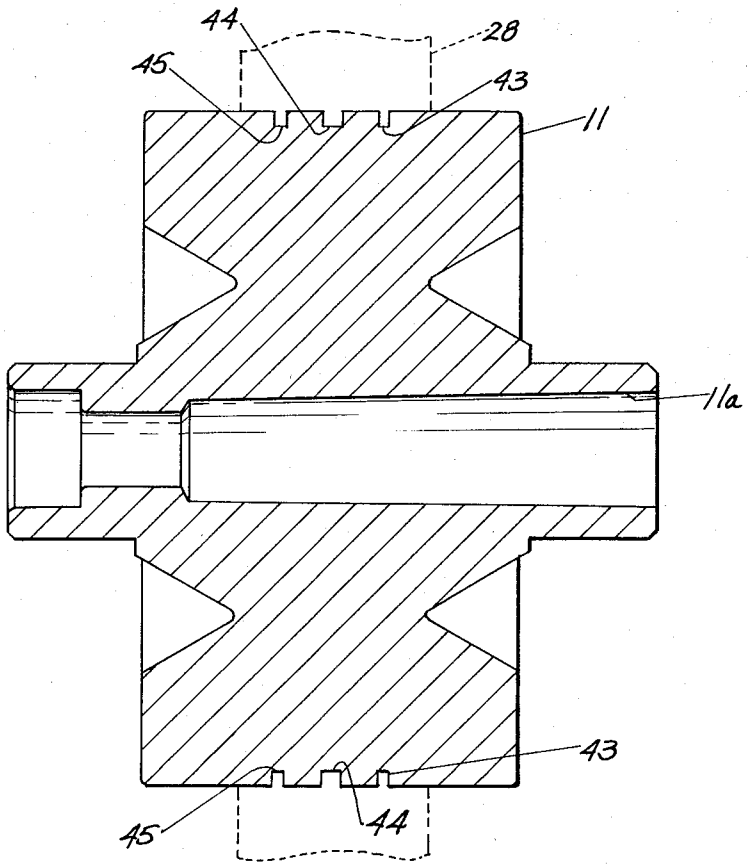
Figure 4:
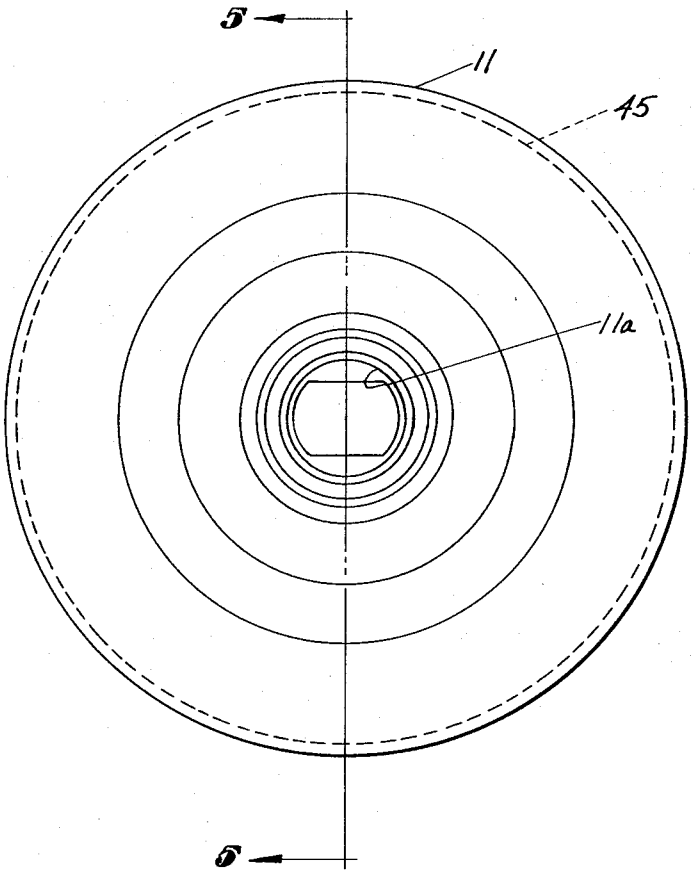
FIG. 4 is an elevational view of the flywheel of the present invention.

The present invention is based upon the discovery that this problem can be solved by providing circumferential grooves about the periphery of the flywheel. The flywheel 11 of FIGS. 1 and 2 is shown enlarged in FIGS. 4 and 5. FIG. 5 also fragmentarily illustrates the driver 28 in broken lines.

The contact between flywheel 11 and driver 28 is substantially a line contact. During the working stroke, this line contact travels about the flywheel and along the driver toward its enlarged end creating a contact area between these two elements. In fact, there is an optimum contact area for a given flywheel 11 and a given driver 28. This optimum contact area depends upon such factors as the size of the tool 1, the materials from which the driver 28 and flywheel 11 are made, the load or amount of squeeze applied to the driver 28 by the flywheel 11, and the like. These factors can readily be determined by one skilled in the art, while designing a particular tool.

While these factors do not constitute a limitation on the present invention, it is important that in providing the flywheel with circumferential grooves, this optimum contact area between flywheel 11 and driver 28 be maintained. This can be accomplished by simply widening at least that portion of the driver 28 contacted by flywheel 11.

In the exemplary embodiment illustrated, the flywheel 11 is provided with three grooves 43, 44 and 45, substantially evenly spaced across the driver 28. It will be understood that the number of grooves can be varied depending upon the size of the tool, the width of the contact line between the flywheel 11 and driver 28, and the like. The width of the grooves 43 through 45 must be sufficient to prevent clogging of the grooves with metal worn from the surface of the driver. In the embodiment shown, the central groove 44 is illustrated as being wider than the remaining grooves 43 and 45. This is true because the nails and the tape on the nails tend to rub the center portion of the driver 28. This results in the greatest accumulation of hot melt glue, nail coating and the like at the longitudinal center of the driver. The depth of grooves 43 through 45 must be sufficient to accommodate the accumulated foreign material.

The grooves 43 through 45 break up the contact area between the flywheel 11 and driver 28. The grooves 43 through 45 provide voids along the driver-flywheel contact line which gives the build-up of foreign material places to flow. Since the material has somewhere to go as it accumulates, it does not build up at the driver-flywheel contact area enough to cause loss of friction therebetween.

In an exemplary, but non-limiting, example, a flywheel 11 having a diameter of about 2.250 inches was used with a driver 28 having a width of about 0.625 inch. Excellent results were achieved by providing three grooves 43 through 45 spaced from each other by a distance of from about 0.120 to about 0.130 inch. Each of the grooves had a depth of from about 0.045 to about 0.050 inch. Grooves 43 and 45 had a width of from about 0.030 to about 0.035 inch, and groove 44 had a width of from about 0.055 to about 0.060 inch.

It has been found that when the flywheel 11 is provided with grooves according to the present invention, the tool 1 can be cycled or fired substantially indefinitely without the formation of a build-up of foreign material at the driver-flywheel contact area sufficient to cause loss of friction therebetween and poor driving action.

It has further been found that the grooves 43 through 45 do not have a tendency to fill with foreign material. While this is not fully understood, it is believed that the foreign material is formed by the grooves into longitudinal ridges which remain primarily on the driver and are accommodated by the grooves, but do not accumulate therein. These ridges tend to slough off the driver during use of the tool.

Finally, it has been found that wear of the driver 28 is greatly reduced in the practice of the present invention, resulting in a longer service life for the driver 28.

When an electro-mechanical fastener driving tool is provided with two driven flywheels, it is preferred that both flywheels be provided with grooves of the type described above. When a single flywheel is used in conjunction with a support element, such as a low inertia roller, a linear bearing, or a Teflon block, it is not necessary to provide the support element with grooves.

Modifications may be made in the invention without departing from the spirit of it.

What is claimed is:

1. In an improved electro-mechanical fastener driving tool of the type having a driver and an electrically driven flywheel, together with a support element to engage said driver and move said driver through a working stroke, the improvement comprising a flywheel containing at least one circumferential groove formed about the periphery of said flywheel whereby to provide at least one void along the flywheel-driver contact line into which foreign material on said driver and said flywheel flows to prevent a build-up of said foreign material thereon and consequent loss of friction therebetween.

2. The structure claimed in claim 1 wherein said support element is chosen from the class consisting of a low inertia roller, a linear bearing, and a Teflon block.

3. The structure claimed in claim 1 wherein said support element comprises a second driven counterrotating flywheel, said second flywheel having at least one circumferential groove formed about the periphery thereof.

4. The structure claimed in claim 1 wherein said flywheel has at least two circumferential grooves in parallel-spaced relationship about the periphery thereof and substantially evenly spaced along said line of contact between said flywheel and said driver.

5. The structure claimed in claim 4 wherein said grooves are of the same depth.

6. The structure claimed in claim 4 wherein said support element is chosen from the class consisting of a low inertia roller, a linear bearing, and a Teflon block.

7. The structure claimed in claim 4 wherein said support element comprises a second driven counterrotating flywheel, said second flywheel having at least one circumferential groove formed about the periphery thereof.

8. The structure claimed in claim 4 wherein said support element comprises a second driven counterrotating flywheel, said second flywheel having at least two circumferential grooves in parallel-spaced relationship about the periphery thereof and substantially evenly spaced along the line of contact between said second flywheel and said driver.

9. The structure claimed in claim 8 wherein said grooves on said second flywheel are of the same depth.

10. The structure claimed in claim 1 wherein said flywheel has an odd number of circumferential grooves greater than one in parallel-spaced relationship about the periphery thereof and substantially evenly spaced along said line of contact between said flywheel and said driver, the center one of said grooves being wider than the remainder of said grooves.

11. The structure claimed in claim 10 wherein said grooves are of the same depth.

12. The structure claimed in claim 10 wherein said support element is chosen from the class consisting of a low inertia roller, a linear bearing, and a Teflon block.

13. The structure claimed in claim 10 wherein said support element comprises a second driven counterrotating flywheel, said second flywheel having at least one circumferential groove formed about the periphery thereof.

14. The structure claimed in claim 10 wherein said support element comprises a second driven counterrotating flywheel, said second flywheel having an odd number of circumferential grooves greater than one in parallelspaced relationship about the periphery thereof and substantially evenly spaced along the line of contact between said second flywheel and said driver, the center one of said grooves being wider than the remainder of said grooves.

15. The structure claimed in claim 14 wherein said grooves on said second flywheel are of the same depth.

16. An improved electro-mechanical fastener driving tool of the type having a driver and rotating flywheel for driving nails collated using strips of material coated with a thermoplastic substance, together with a support element to frictionally engage said driver between said flywheel and said support element and move said driver through a working stroke, wherein the improvement comprises: a flywheel containing at least one circumferential groove formed about its periphery, said groove defining an area along the driver-flywheel contact line into which said thermoplastic substance from said collating strip flows to prevent an accumulation of said thermoplastic substance on the outer surface of said flywheel and a consequent loss of frictional surface.

17. The structure claimed in claim 16 wherein said flywheel has at least two circumferential grooves in parallel-spaced relationship about the periphery thereof and substantially evenly spaced along said line of contact between said flywheel and said driver.

18. The structure claimed in claim 16 wherein said support element is chosen from a class consisting of a low inertia roller, a linear bearing, and a low friction block.

19. The structure claimed in claim 16 wherein said support element comprises a second counterrotating flywheel having at least one circumferential groove formed about the periphery thereof.

* * * * *